US006819039B2

(12) United States Patent
Fujihara et al.

(10) Patent No.: US 6,819,039 B2
(45) Date of Patent: Nov. 16, 2004

(54) GLASS FUNNEL FOR PROJECTION CATHODE RAY TUBE WITH INTEGRALLY FORMED PAD PORTIONS

(75) Inventors: Shigeo Fujihara, Otsu (JP); Osamu Odani, Otsu (JP)

(73) Assignee: Nippon Electric Glass Co., Ltd., Shiga-ken (JP)

( * ) Notice: Subject to any disclaimer, the term of this patent is extended or adjusted under 35 U.S.C. 154(b) by 26 days.

(21) Appl. No.: 10/328,840

(22) Filed: Dec. 24, 2002

(65) Prior Publication Data

US 2003/0122475 A1 Jul. 3, 2003

(30) Foreign Application Priority Data

Dec. 25, 2001 (JP) ..... 2001-391668

(51) Int. Cl.[7] ..... H01J 31/00

(52) U.S. Cl. ..... 313/477 R; 220/2.3 A; 445/8; 348/818; 348/825; 348/836; 348/821

(58) Field of Search ..... 313/477 R; 220/2.3 A; 445/8; 348/818, 825, 836, 821

(56) References Cited

U.S. PATENT DOCUMENTS 6,427,490 B1 * 8/2002 Bordt et al. ..... 65/68

FOREIGN PATENT DOCUMENTS

| | | | |
|---|---|---|---|
| JP | 4318122 | * | 7/1968 |
| JP | 43-18122 | | 7/1968 |
| JP | 61-034826 | | 2/1986 |
| JP | 6310447 | * | 1/1988 |
| JP | 07-122206 | | 5/1995 |

* cited by examiner

*Primary Examiner*—Nimeshkumar D. Patel
*Assistant Examiner*—Holly Harper
(74) *Attorney, Agent, or Firm*—J.C. Patents

(57) ABSTRACT

Pad portions are respectively integrally protruded to be formed on an outer surface of a substantially funnel-shaped sidewall portion of the glass funnel for projection. A ridge-line for a reference end face formed on the pad portion comprises a first curved portion to form a top portion and second curved portions to form rising portions. The first curved portion and the second curved portions are smoothly continuous to each other without bending portions. The second curved portion is smoothly continuous to the outer face of the sidewall portion without bending portions.

8 Claims, 4 Drawing Sheets

GLASS FUNNEL FOR PROJECTION CATHODE RAY TUBE WITH INTEGRALLY FORMED PAD PORTIONS

CROSS-REFERENCE TO RELATED APPLICATION

This application claims the priority benefit of Japanese application ser. no. 2001-391668, filed on Dec. 25, 2001

BACKGROUND OF THE INVENTION

1. Field of the Invention

This invention relates in general to a glass funnel for projection in which pad portions for fixing a cooling means are integrally formed to be protruded on outer surfaces of a sidewall portion.

2. Description of Related Art

Conventionally, as a cathode ray tube (CRT) being a major constituting part of a television set and the like, so-called a direct-view type cathode ray tube and a projection cathode ray tube are known. The cathode ray tube comprises a panel having a face portion with a substantially rectangular shape to display an image, and a funnel having substantially funnel-shaped sidewall portion extending from a large opening portion with a substantially rectangular shape to a small opening portion with a substantially circular shape. A neck portion in which an electron gun is inserted is connected to the small opening portion. The panel and the funnel can be made by press molding a molten glass using molds that comprise a female mold and a male mold.

Compared with the direct-view type cathode ray tube having a structure to display an image by arranging three primary colors of light in R, G, B on a display screen, the projection cathode ray tube uses three cathode ray tubes to irradiate R, G, B lights respectively, and then to display an image by focusing these lights to enlargely project onto a screen. For the projection cathode ray tube, because the light on the display screen has to be enlarged and projected, display characteristics of the high brightness and the high fineness are required than the direct-view type cathode ray tube. Accordingly, the panel of the projection cathode ray tube is usually at a very high temperature, so that a cooling means is usually attached onto the surface of the panel.

The cooling means has to be properly arranged to a position separated by a prescribed distance to a fluorescent face formed on the face portion of the panel. For example, as disclosed in Japanese publication No. 5-27209, pad portions, which serve as positioning portions of an instrument to fix the cooling means, are integrally formed on the sidewall portions of the funnel to which the panel is sealed. The pad portion has an end face that is substantially perpendicular to a central axis line of the funnel, and the end face is used as a reference end face for positioning the cooling means. Furthermore, the pad portion has a side face extending towards the large opening portion side from the reference end face to an outer surface of the sidewall portion.

In the conventional art, as conditions required by the pad portion mentioned above, because only positioning the cooling means properly by the reference end face is regarded as important, the planarity of the reference end face is the only thing to be noticed. However, the shape of the reference end face or the shape of a joining portion between the pad portion and the outer surface of the sidewall portion of the funnel is not particularly concerned.

Accordingly, the pad portion, which is tried to design or manufacture, has a shape as shown in FIGS. 4A to 4C That is, as shown in FIG. 4A, a ridgeline of the reference end face 7' of the pad portion 6' are shaped such that it has a straight line portion on a top portion, and rising portions 9', 9' from the outer surface 4*a*' of the sidewall portion 4' are connected in bending form to the both sides of the straight line portion 8'. In addition, joining portions between the outer surface 4*a*' of the sidewall portion 4' and the rising portions 9', 9' are formed with small circular arcs each of which, for example, has a curvature radius less than 10 mm.

Furthermore, as shown in FIG. 4B, as viewing from a direction perpendicular to an imaginary plane including the central axis line Z' of the funnel and passing the top portion 8', a gradient of a first side face 10' extending toward the large opening portion side (the arrow A side) from the top portion 8' of the reference end face 7' to the outer surface 4*a*' of the sidewall portion 4', i.e., an inclination angle $\alpha'$ of the first side face 10' with respect to the central axis line Z' of the funnel, is set less than 10°. Moreover, the curvature radius of the joining portion 12' between the first side face 10' and the outer surface 4*a*' of the sidewall portion 4' is set, for example, less than 3 mm. Furthermore, the curvature radius of the joining portion 11' between the outer surface 4*a*' of the sidewall portion 4' and the edge of the reference end face 7' at the side of the central axis line Z' of the funnel is set, for example, less than 3 mm.

As shown in FIG. 4B i.e., a vertically cross-sectional view cut along the line y—y in FIG. 4B and along the line x—x in FIG. 4A, as viewing from a direction along an imaginary line directing toward an adjacent portion between the top portion 8' of the reference end face 7' and the rising portion 9' from the central axis line Z' of the funnel in the direction perpendicular to the central axis line Z', the gradient of the second side face 13' extending towards the large opening portion side from the adjacent portion of the reference end face 7' to the outer surface 4*a*' of the sidewall portion 4', i.e., the expanding angle (the inclination angle) $\beta'$ with respect to the central axis line Z' of the funnel is set less than 10°. In addition, the curvature radius of a joining portion 14' between the second side face 13' and the outer surface 4*a*' of the sidewall portion 4' is set less than 3 mm, and the curvature radius of a joining portion 15' between the reference end face 7' and an entire side face including the first side face 10' and the second side face 13' is set less than 2 mm.

After the above pad portion structure is proposed, to improve the efficiency related to the press molding of the glass funnel for projection is pursued. As a result, a property of taking the glass funnel out of the mold (female mold) or moldability is pursued.

For example, as described above, the top portion of the pad portion has the straight line portion and the bending portions formed at the both sides thereof, the curvature radius of the joining portions between each portion of the pad portion and the outer surfaces of the sidewall portion is small, the gradient of the side face of the pad portion is small, which cause following problems. Namely, during the press molding for the funnel, it is very difficult to fill a sufficient amount of glass to molding faces corresponding to the pad portions of the mold, so that defects due to the insufficient filling will occur, the property of taking the funnel out of the mold gets worse, and scratches or minute cracks may occur on the pad portions.

In order to eliminate such problems, lubricant is tried to provide to the molding faces corresponding to the pad portions of the mold. However, this solution causes new problems, such as the occurrence of oil stain or wrinkle caused by the lubricant. Theoretically, it is possible to provide a good property of taking the funnel out of the mold by reducing the temperature of the mold, but it is very difficult to maintain an optimum temperature. Therefore, even though the extent of the temperature lowering is slightly excessive, disadvantages such as occurrence of cracks might be caused.

Moreover, to change the molding method or the molding condition to attempt to solve the above problem, not only requires considerable time and labor, but also requires delicate temperature adjustment, and therefore, experience is required. However, in spite of the above problem, if responding to the high quality level in recent years, the production yield gets worse greatly.

SUMMARY OF THE INVENTION

According to the foregoing description, an object of this invention is to provide a glass funnel for projection to effectively improve the shape of the pad portions of the funnel, and additionally to improve the moldability and the property of taking the funnel out of the mold. Thereby, problems, such as the occurrence of scratches or minute cracks on the pad portions, or the insufficient filling of glass, can be avoided, so that the product yield can be effectively improved.

In order to achieve at least object mentioned above, the present invention provides a glass funnel for projection comprising a substantially funnel-shaped sidewall portion which has a large opening portion with a substantially rectangular shape and a small opening portion with a substantially circular shape, and pad portions for fixing a cooling means, each of the pad portions being integrally formed to be protruded on an outer surface of the sidewall portion, wherein a ridgeline for a reference end face, formed at an end portion of the pad portion at the small opening portion side, comprises a first curved portion to form a top portion and a second curved portion to form rising portions, and wherein the first curved portion and the second curved portion are smoothly continuous to each other without bending portion therebetween, and the second curved portion is smoothly continuous to the outer surface of the sidewall portion without bending portion therebetween. The "ridgeline for a reference end face" means a ridgeline for the reference end face protruding with respect to the outer surface of the sidewall portion.

According to the above structure, the top portion of the reference end face of the pad portion is formed with a first curved portion, and the rising portions from the outer surface of the sidewall portion are respectively formed with the second curved portion. Moreover, because there are no bending portions between the top portion and the rising portions, and between the rising portions and the outer surface of the sidewall portion, the glass flow in the mold during the press molding for the funnel becomes very smooth. In this way, glass is properly and sufficiently filled from the rising portions to the top portions of the pad portions, so that occurrence of wrinkles or insufficient filling of glass can be effectively avoided. Furthermore, the property of taking the funnel out of the mold or the releasability of removing the funnel from the mold can be improved, so that occurrence of scratches or minute cracks on the pad portions can be effectively avoided.

Preferably, the ridgeline for the reference end face may formed with only a plurality of curved portions. Accordingly, the obstruction to the glass flow during the press molding, which is caused by the existence of the straight line portion on the top portion of the reference end face, can be avoided. Because the glass fluidity gets better, occurrence of wrinkles or insufficient filling of glass can be more firmly avoided.

In this situation, the first curved portion is formed with a circular arc (a single circular arc), and preferably, the curvature radius of the circular arc may be in the range from 2 mm or greater to 20 mm or less. Namely, when the top portion of the reference end face is formed with the circular arc, as compared with other curved shape, design and manufacture for the mold or the maintenance becomes easier. If the curvature radius of the circular arc is less than 2 mm, insufficient filling of glass to the periphery of the top portion during the press molding cannot be avoided. Additionally, because the shape of the top portion is near a bending shape, obstruction to the glass flow cannot be avoided, too. In contrast, if the curvature radius of the circular arc exceeds 20 mm, the length of the reference end face along the outer surface of the sidewall portion is too long, and a range where the sidewall portion is thick due to the existence of the pad portions becomes broad. As a result, cooling at the pad portions after the press molding becomes insufficient than other portions, which becomes a major reason of the occurrence of deformations or scratches, etc. Therefore, when the curvature radius of the circular arc of the top portion is set within the above range, the above disadvantages can be effectively avoided.

In addition, the second curved portion is formed with a circular arc, and preferably, a curvature radius of the circular arc is in the range from 10 mm or greater to 500 mm or less. Namely, if the curvature radius of the circular arc of the rising portion is less than 10 mm, the pad portion becomes a shape that rises abruptly from the outer surface of the sidewall portion, which causes problems, such as obstruction to the glass flow or insufficient filling of glass. In contrast, if the curvature radius of the circular arc exceeds 500 mm, the rising portion of the pad portion rises too slow and spreads along the outer surface of the sidewall portion. Therefore, the pad portion and the sidewall portion have no difference apparently, and a lot of useless portions are formed on the pad portion, which is disadvantageous for saving material. Therefore, when the curvature radius of the circular arc of the rising portion is set within the above range, the above disadvantages can be effectively avoided.

Furthermore, as viewing from a direction perpendicular to an imaginary plane that includes the central axis line of the funnel and passes through the top portion, the first side face extending towards the large opening portion side from the top portion of the reference end face of the pad portion to the outer surface of the sidewall portion may be inclined so as to approach the central axis line of the funnel as going toward the small opening portion side. Preferably, the inclination angle of the first side face with respect to the central axis line of the funnel may be in the range from 10° or greater to 45° or less. Namely, if the inclination angle, i.e., the gradient, of the first side face of the pad portion is less than 10°, the property of taking the funnel out of the mold after the press molding gets worse. Therefore, scratches or minute cracks, etc. occur on the pad portions and the quality degradation is unavoidable. In contrast, if the inclination angle exceeds 45°, the pad portion and the sidewall portion have no difference apparently, and a lot of useless portions are formed on the pad portion, which is disadvantageous in the material cost. Therefore, when the inclination angle of the first side face is set within the above range, the above disadvantages can be effectively avoided.

The edge of the reference end face at the side of the central axis line of the funnel may be continuous to the outer surface of the sidewall portion through a third curved portion, and the edge of the first side face at the large opening portion side may be continuous to the outer surface of the sidewall portion through a fourth curved portion. Preferably, the third and the fourth curved portions may be respectively formed with a circular arc a curvature radius of which is in the range from 5 mm or greater to 500 mm or less. Namely, if the curvature radius is less than 5 mm, the shape change is abrupt in a process going from the sidewall portion to the top portion, and therefore, obstruction to the glass flow or insufficient filling of glass during the press molding cannot be avoided, which becomes a major cause of the occurrence of wrinkles or deficiencies. In contrast, if the curvature radius exceeds 500 mm, a range where the sidewall portion is thick due to the existence of the pad portions is broad, which causes a problem of insufficient cooling for the pad portions after the press molding. Therefore, if the curvature radii of the third and fourth side faces are set within the above range, the above disadvantages can be effectively avoided.

Moreover, as viewing from a direction along an imaginary line directing toward an adjacent portion between the top portion of the reference end face of the pad portion and the rising portion from the central axis line of the funnel in a direction perpendicular to the central axis line, a second side face extending towards the large opening portion side from the adjacent portion to the outer surface of the sidewall portion may be inclined so as to approach the central axis line of the funnel as going toward the small opening portion side. The inclination angle with respect to the central axis line of the funnel may be in the range from 15° or greater to 45° or less. The edge of the second side face at the large opening portion side may be continuous to the outer surface of the sidewall portion through a fifth curved portion. Preferably, the fifth curved portion is formed with a circular arc a curvature radius of which may be in the range from 5 mm or greater to 500 mm or less. In this situation, to construct the circular arc forming the fifth curved portion with a curvature radius from 5 mm or greater to 500 mm or less has the same reasons as the third and the fourth curved portions mentioned above. On the other hand, if the inclination angle of the second side face is less than 15°, the property of taking the funnel out of the mold after the press molding gets worse and scratches or minute cracks, etc. occur on the pad portions, so that the quality degrade. In contrast, if the inclination angle exceeds 45°, a lot of useless portions are formed on the pad portion, which is disadvantageous in the material cost. Therefore, when the inclination angle of the second side face is set within the above range, the above disadvantages can be effectively avoided.

It is better that the entire region of the joining portions of the pad portion to the outer surface of the sidewall portion are formed with the curved portions. Namely, when not only a portion of the joining portions, but the entire region are formed with the curved portions, the moldability can be greatly improved, a funnel superior in the quality can be provided without requiring skilled experience, and the production yield can be increased.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
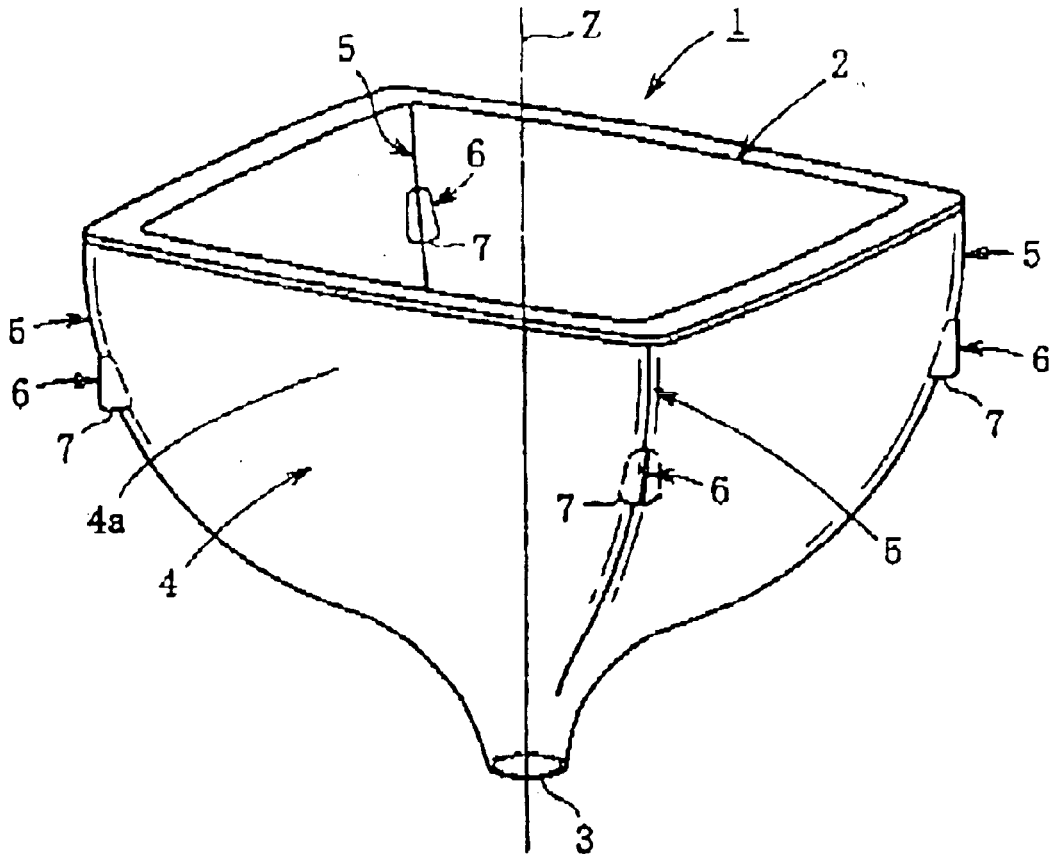
FIG. 1 is a perspective view of a glass funnel for projection according to the embodiment of the present invention.

The preferred embodiment according to the present invention is described in detail accompanying with the attached drawings. As shown in FIG. 1, the glass funnel for projection 1 (funnel 1, hereinafter) of the embodiment comprises a large opening portion 2 with a substantially rectangular shape formed at one end of a central axis line Z, a small opening portion 3 with a substantially circular shape formed at the other end of the central axis line Z, and a substantially funnel-shaped sidewall portion 4 extending from the large opening portion 2 to the small opening portion 3. Four pad portions 6 for fixing a cooling means (not shown) are integrally protruded to be formed on the outer surface of each diagonal portion 5 of the sidewall portion 4. The pad portion 6 has a reference end face 7 at the end thereof at the side of the small opening 3, as a positioning reference for the cooling means.

Figure 2A:
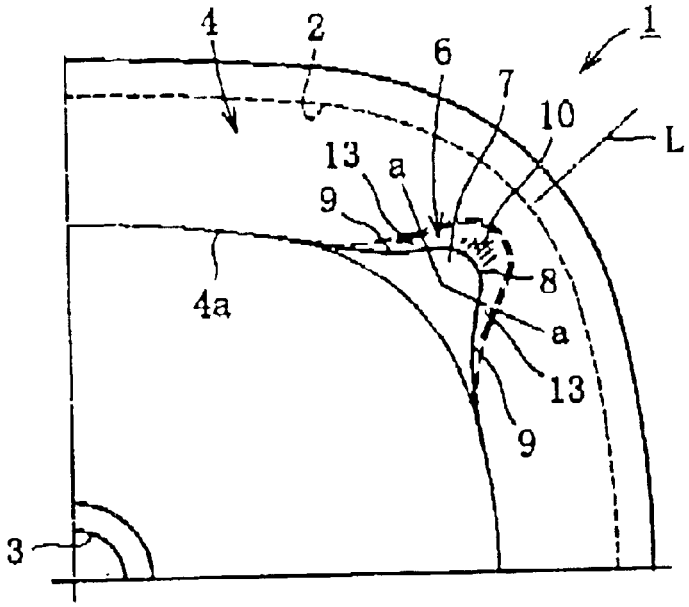
FIG. 2A is an enlarged bottom view showing major parts of the glass funnel for projection according to the embodiment of the present invention.

As shown in FIG. 2A, a ridgeline for the reference end face 7 of the pad portion 6 comprises a first curved portion 8 that forms a top portion , and second curved portions 9, 9 that form rising portions from the outer surface 4*a* of the sidewall portion 4. The first curved portion 8 and the second curved portions 9, 9 are smoothly continuous to each other without bending portions. In addition, the second curved portions 9, 9 and the outer surface 4*a* of the sidewall portion 4 are smoothly continuous to each other without bending portions.

In this situation, the first curved portion 8 is formed with a circular arc with a curvature radius from 2 mm or greater to 20 mm or less, preferably, about 5 mm or 6 mm. Additionally, each of the second curved portions 9, 9 is formed with a circular arc with a curvature radius from 10 mm or greater to 500 mm or less, preferably, about from 5 mm to 30 mm. In the embodiment, the circular arc forming the first curved portion 8 and the circular arcs forming the second curved portions 9, 9 are directly continuous to each other. Therefore, the ridgeline of the reference end face 7 is formed with only three circular arcs.

Figure 2B:
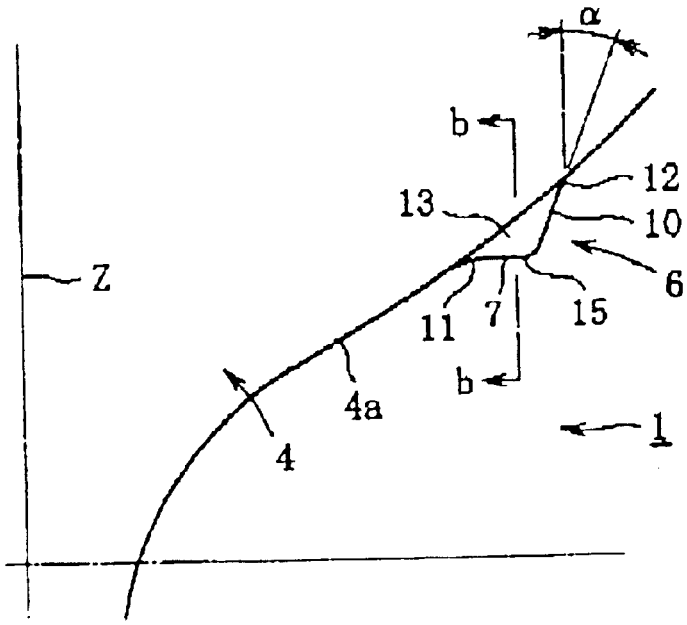
FIG. 2B is a plane view as viewing from a direction perpendicular to the diagonal axis.

As shown in FIG. 2B, as viewing from a direction perpendicular to an imaginary plane that includes the central axis line Z of the funnel and passes through the top portion 8, a first side face 10 extending towards the side of the large opening portion 2 from the top portion 8 of the reference end face 7 to the outer surface 4*a* of the sidewall portion 4 is inclined so as to approach the central axis line Z of the funnel as going toward the side of the small opening portion 3. The inclination angle α of the first side face 10 with respect to the central axis line Z of the funnel is in the range from 10° or greater to 45° or less, preferably, is set about 20°. Moreover, the edge of the reference end face 7 at the side of the central axis line Z of the funnel is continuous to the outer surface 4*a* of the sidewall portion 4 through a third curved portion 11, and the edge of the first side face 10 at the side of the large opening portion 2 is continuous to the outer surface 4*a* of the sidewall portion 4 through a fourth curved portion 12. Each of the third curved portion 11 and the fourth curved portion 12 is formed with a circular arc with a curvature radius from 5 mm or greater to 500 mm or less, preferably, about 10 mm.

Figure 2C:
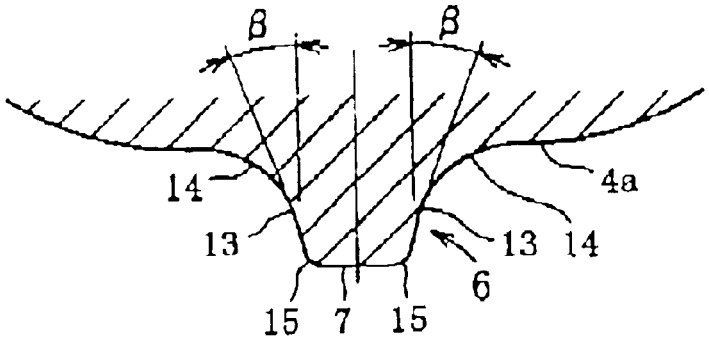
FIG. 2C is a vertically cross-sectional view cut along the line a—a in FIG. 2A and along the line b—b in FIG. 2B.

As shown in FIG. 2C, as viewing from a direction along an imaginary line directing toward an adjacent portion between the top portion 8 of the reference end face 7 and the rising portion 9 from the central axis line Z of the funnel in the direction perpendicular to the central axis line Z, a second side face 13 extending towards the side of the large opening portion 2 from the adjacent portion of the reference end face 7 to the outer surface 4*a* of the sidewall portion 4 is inclined so as to approach the central axis line Z of the funnel as going toward the side of the small opening portion 3. The inclination angle β of the second side face 13 with respect to the central axis line Z of the funnel is in the range from 15° or greater to 45° or less, preferably, is set about 20°. Moreover, the edge of the second side face 13 at the side of the large opening 2 is continuous to the outer surface 4*a* of the sidewall portion 4 through fifth curved portions 14, 14. The fifth curved portion 14 is formed with a circular arc with a curvature radius from 5 mm or greater to 500 mm or less, preferably, about 10 mm.

Furthermore, the entire region of a side face comprising the first side face 10 and the second side face 13, and the entire region of the reference end face 7 are continuous to each other through a six curved portion 15. The six curved portion 15 is formed with a circular arc with a curvature radius from 2 mm or greater to 5 mm or less, preferably, about 3 mm. In addition, the entire region of the side face is formed with only an arc-shaped curved face as viewing from the bottom. The edge of the entire region of the side face at the side of the large opening portion 2, including the fourth curved portion 12 and the fifth curved portion 15, is continuous to the outer surface 4*a* of the sidewall portion 4 through the curved portions over the entire circumference. Therefore, the joining portions of the pad portion 6 to the outer surface 4*a* of the sidewall portion 4 composed of the entire region of the side face and the reference end face 7 are formed with curved portions over the entire circumference.

Figure 3:
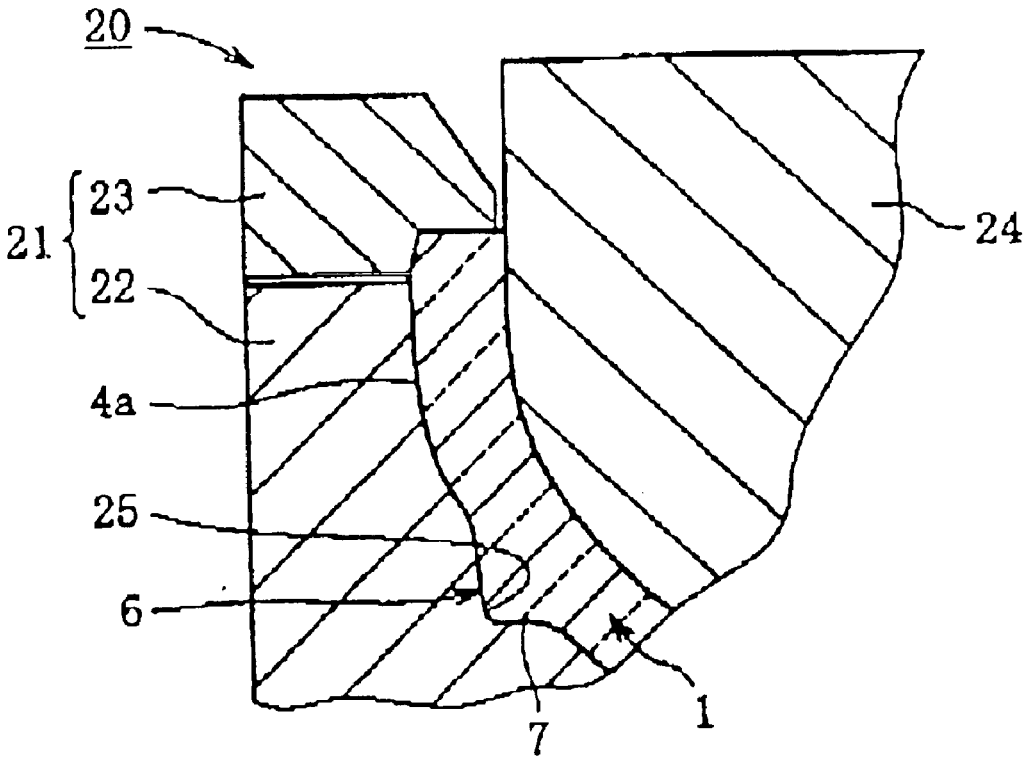
FIG. 3 is a vertically cross-sectional view showing the glass funnel for projection and a mold device used for making the same according to the embodiment of the present invention.
Figure 4A:
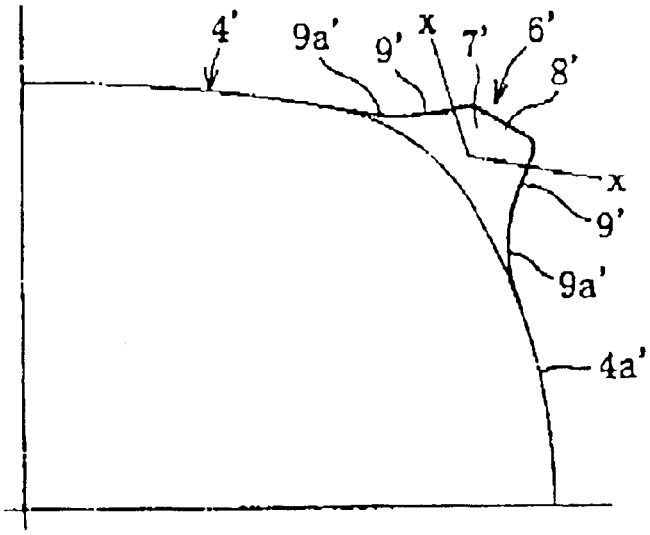
FIG. 4A is an enlarged bottom view showing major parts of a conventional glass funnel for projection.
Figure 4B:
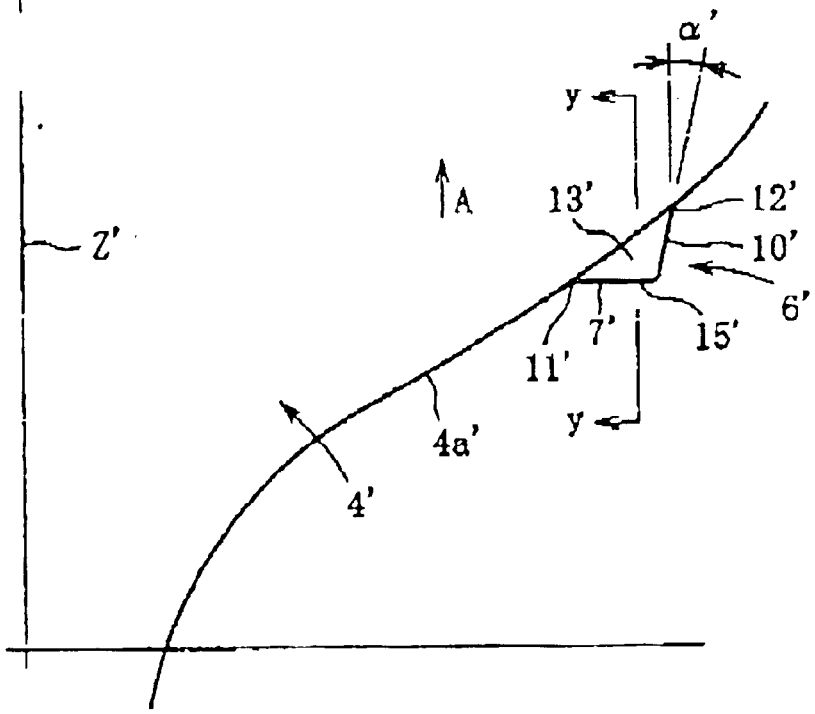
FIG. 4B is a plane view as viewing from a direction perpendicular to the diagonal axis.
Figure 4C:
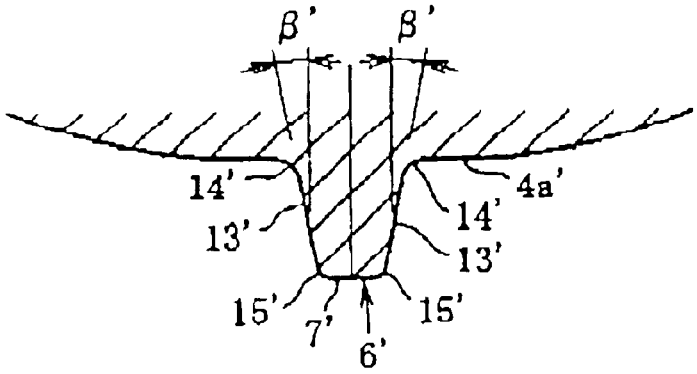
FIG. 4C is a vertically cross-sectional view cut along the line x—x in FIG. 4A and along the line y—y in FIG. 4B.

FIG. 3 shows a mold device 20 used to manufacturing the funnel 1 according to the embodiment of the present invention. The female mold 21 of the mold device 20 comprises a bottom mold 22 for supplying a molten glass gob, and a shell mold 23 that is arranged atop the bottom mold 22 to be capable of moving upwards and downwards. A plunger 24 as a male mold is arranged above the female mold 21 to be capable of moving upwards and downwards. The bottom mold 22 has a molding face for prescribing a shape of the outer surface 4*a* of the sidewall portion 4 of the funnel 1. Concave molding face portions 25 corresponding to the pad portions 6 are formed on the molding face.

For using the mold device 20 to press mold the funnel 1, as shown in FIG. 3, a molten glass gob is supplied to the bottom mold 22, and then the plunger 24 is lowered to press and extend the molten glass gob to mold the shape of the funnel 1 by the bottom mold 22, the shell mold 23 and the plunger 24. After molding, the plunger 24 is risen and the shell mold 23 is further risen. Afterwards, the funnel 1 is cooled and removed out of the bottom mold 22. At this time, the press molding process is finished. As a result, the funnel 1 with the pad portions 6 is obtained.

In this situation, regarding each pad portion 6 of the funnel 1, the ridgeline for the reference end face 7 is formed by the first curved portion 8 and the second curved portions 9; the joining portion between the reference end face 7 and the outer surface 4*a* of the sidewall portion 4 is formed by the third curved portion 11; the joining portions between the outer surface 4*a* of the sidewall portion 4 and the entire region of the side face comprising the first side face 10 and the second side face 13 is entirely formed by the curved portion comprising the fourth curved portion 12 and the fifth curved portion 14; the joining portion between the entire region of the side face and the reference end face 7 is formed by the six curved portion 15; and the first side face 10 and the second side face 13 are inclined with respect to the central axis line Z of the funnel by sufficient angles α, β. If considering the above constructions, the moldability for the funnel 1 during the press molding can be greatly improved, and additionally, the property of taking the funnel 1 out of the bottom mold 22 can be also greatly improved.

Namely, obstructing the glass flow at the pad portions 6 or insufficiently filling glass to the pad portion 6 during the press molding can be effectively avoided. Additionally, causes of creating scratches or minute cracks on the side face of the pad portion 6 or the reference end face 7 when removing the funnel 1 can be effectively eliminated. In this way, the quality of the funnel 1 can be improved and the production yield can be greatly increased.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A glass funnel with projections comprising a substantially funnel-shaped sidewall portion which has a large opening portion with a substantially rectangular shape and a small opening portion with a substantially circular shape, and pad portions for fixing a cooling means, each of the pad portions being integrally formed to be protruded on an outer surface of the sidewall portion, wherein a ridgeline for a reference end face, formed at an end portion of the pad portion at the small opening portion side, comprises a first curved portion to form a top portion and a second curved portions to form rising portions, and wherein the first curved portion and the second curved portion are smoothly continuous to each other, and the second curved portion is smoothly continuous to the outer surface of the sidewall portion.

2. The glass funnel with projections according to claim 1, wherein the ridgeline for the reference end face is formed with only a plurality of curved portions.

3. The glass funnel with projections according to claim 1, wherein the first curved portion is formed with a circular arc a curvature radius of which is in the range from 2 mm or greater to 20 mm or less.

4. The glass funnel with projections according to claim 1, wherein the second curved portion is formed with a circular arc a curvature radius of which is in the range from 10 mm or greater to 500 mm or less.

5. The glass funnel with projections according to claim 1, wherein as viewing from a direction perpendicular to an imaginary plane that includes a central axis line of the funnel and passes through the top portion of the reference end face of the pad portion, a first side face extending from the top portion toward the large opening portion side to the outer surface of the sidewall portion is inclined so as to approach the central axis line of the funnel as going toward the small opening portion side, and wherein an inclination angle of the first side face with respect to the central axis line of the funnel is in the rage from 10° or greater to 45° or less.

6. The glass funnel with projections according to claim 1, wherein an edge of the reference end face at the side of a central axis line of the funnel is continuous to the outer surface of the sidewall portion through a third curved portion, and an edge of the first side face at the large opening portion side is continuous to the outer surface of the sidewall portion through a fourth curved portion, and wherein each of the third and the fourth curved portions is formed with a circular arc a curvature radius of which is in the range from 5 mm or greater and 500 mm or less.

7. The glass funnel with projections according to claim 1, wherein as viewing from a direction along an imaginary line that directs from a central axis line of the funnel toward an adjacent portion between the top portion of the reference end face of the pad portion and the rising portions in a direction perpendicular to the central axis line of the funnel, a second side face extending from the adjacent portion toward the large opening portion side to the outer surface of the sidewall portion is inclined so as to approach the central axis line of the funnel as going toward the small opening portion side, and wherein an inclination angle of the second side face with respect to the central axis line of the funnel is in the range from 15° or greater to 45° or less, and wherein an edge of the second side face at the large opening portion side is continuous to the outer surface of the sidewall portion through a fifth curved portion, and the fifth curved portion is formed with a circular arc a curvature radius of which is in the range from 5 mm or greater to 500 mm or less.

8. The glass funnel with projections according to claim 1, wherein an entire region of the joining portions of the pad portion to the outer surface of the sidewall portion are formed with the curved portions.

* * * * *